US012442125B2

(12) United States Patent
Bellinger et al.

(10) Patent No.: US 12,442,125 B2
(45) Date of Patent: Oct. 14, 2025

(54) FOREIGN PARTICULATE COLLECTOR FOR A LAUNDRY APPLIANCE

(71) Applicant: WHIRLPOOL CORPORATION, Benton Harbor, MI (US)

(72) Inventors: Ryan Robert Bellinger, St. Joseph, MI (US); Timothy Noah Blatchley, Stevensville, MI (US); Mark Jason Christensen, Stevensville, MI (US); Ryan Douglas Kuhn, St. Joseph, MI (US); Nolan Robert Maryanski, Stevensville, MI (US); Wesley Paul Traylor, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 754 days.

(21) Appl. No.: 17/859,298

(22) Filed: Jul. 7, 2022

(65) Prior Publication Data

US 2023/0046936 A1 Feb. 16, 2023

Related U.S. Application Data

(60) Provisional application No. 63/232,260, filed on Aug. 12, 2021.

(51) Int. Cl.
*D06F 58/22* (2006.01)
*D06F 58/02* (2006.01)

(52) U.S. Cl.
CPC ..... *D06F 58/22* (2013.01); *D06F 58/02* (2013.01)

(58) Field of Classification Search
CPC ..... D06F 58/22; D06F 58/02
USPC ..... 34/318, 595–610
See application file for complete search history.

(56) References Cited

U.S. PATENT DOCUMENTS

| | | | | |
|---|---|---|---|---|
| 2,780,009 | A * | 2/1957 | Stickel | D06F 58/24 34/79 |
| 4,920,662 | A | 5/1990 | Seeburger | |
| 5,210,960 | A * | 5/1993 | LaRue | F26B 25/007 D32/30 |
| 6,576,323 | B2 | 6/2003 | Wise et al. | |
| 7,441,345 | B2 | 10/2008 | Taylor | |
| 8,056,254 | B2 * | 11/2011 | Loffler | D06F 58/22 34/82 |
| 8,869,421 | B2 * | 10/2014 | Kim | D06F 58/22 34/418 |
| 9,951,464 | B2 * | 4/2018 | Lee | D06F 58/22 |
| 10,100,459 | B2 * | 10/2018 | Groppel | D06F 58/10 |

(Continued)

FOREIGN PATENT DOCUMENTS

| | | | |
|---|---|---|---|
| CN | 114575120 | A | 6/2022 |
| DE | 8224528 | U1 | 2/1983 |

(Continued)

*Primary Examiner* — Stephen M Gravini
(74) *Attorney, Agent, or Firm* — Price Heneveld LLP

(57) ABSTRACT

A laundry appliance includes a cabinet defining an opening. A drum is disposed within the cabinet and defines a processing space. A blower directs process air through an airflow path that includes the drum. A door is operably coupled to the cabinet. The door is operable to an open position that provides selective access through the opening and into the drum. A foreign particulate collector is operably coupled to the door. The foreign particulate collector includes a collection material configured to collect foreign particulates within the drum.

20 Claims, 11 Drawing Sheets

(56) References Cited

U.S. PATENT DOCUMENTS

| | | | | |
|---|---|---|---|---|
| 10,280,551 | B2 | 5/2019 | Sweigart | |
| 10,531,784 | B2 | 1/2020 | Sweigart | |
| 10,662,572 | B2 * | 5/2020 | Kang | D06F 58/20 |
| 10,941,513 | B2 * | 3/2021 | MacDonald, III | D06F 58/22 |
| 12,139,843 | B2 * | 11/2024 | Bauer | D06F 39/10 |
| 12,227,890 | B2 * | 2/2025 | Lee | D06F 21/02 |
| 12,325,949 | B2 * | 6/2025 | Bae | D06F 58/24 |
| 2010/0050465 | A1 * | 3/2010 | Im | D06F 58/30 34/499 |
| 2017/0055807 | A1 | 3/2017 | Rucki | |
| 2020/0238202 | A1 * | 7/2020 | Renz | B01D 29/09 |

FOREIGN PATENT DOCUMENTS

| | | | | |
|---|---|---|---|---|
| DE | 102013008483 | | 11/2014 | |
| EP | 2476790 | A1 * | 7/2012 | D06F 17/10 |
| JP | 09290097 | A | 11/1997 | |
| JP | 6880164 | B2 * | 6/2021 | D06F 37/065 |
| KR | 20120082968 | A * | 7/2012 | D06F 17/10 |
| WO | 2019199269 | | 10/2019 | |

* cited by examiner

A Method 400 for Collecting Foreign Particulate during Performance of a Laundry Cycle A Method 500 for Collecting Foreign Particulate during Performance of a Laundry Cycle

FOREIGN PARTICULATE COLLECTOR FOR A LAUNDRY APPLIANCE

CROSS-REFERENCE TO RELATED APPLICATION

This application claims priority to and the benefit under 35 U.S.C. § 119(e) of U.S. Provisional Patent Application No. 63/232,260, filed on Aug. 12, 2021, entitled FOREIGN PARTICULATE COLLECTOR FOR A LAUNDRY APPLIANCE, the entire disclosure of which is hereby incorporated herein by reference.

BACKGROUND OF THE DISCLOSURE

The present disclosure generally relates to a laundry appliance, and more specifically, to a foreign particulate collector for a laundry appliance.

SUMMARY OF THE DISCLOSURE

According to one aspect of the present disclosure, a laundry appliance includes a cabinet defining an opening. A drum is disposed within the cabinet and defines a processing space. A blower directs process air through an airflow path that includes the drum. A door is operably coupled to the cabinet. The door is operable to an open position that provides selective access through the opening and into the drum. A foreign particulate collector is operably coupled to the door. The foreign particulate collector includes a collection material configured to collect foreign particulates within the drum.

According to another aspect of the present disclosure, a method for collecting particulate during performance of a laundry cycle of a laundry appliance includes applying a spray to at least one of an inner surface of a door and an interior surface of a rotating drum for a laundry appliance. The spray defines a tacky layer. Articles to be processed are disposed within the drum. A laundry cycle is operated, where rotation of the drum directs the articles against the tacky layer. Foreign particulate is collected, where engagement of the articles with the tacky layer transfers the foreign particulate from the articles to the tacky layer. The laundry cycle is completed. The tacky layer is removed from the appliance.

According to yet another aspect of the present disclosure, a method for collecting particulate during performance of a laundry cycle of a laundry appliance includes disposing articles to be processed within a drum. A consumable orb is disposed within the drum, where the consumable orb includes a plurality of disposable tacky layers. A laundry cycle is operated, where rotation of the drum moves the consumable orb within the articles. Foreign particulate is collected, where engagement of the articles with an outermost tacky layer of the plurality of disposable tacky layers transfers the foreign particulate from the articles to the outermost tacky layer. A drying cycle is completed. The outermost tacky layer is removed from the consumable orb to define a new outermost tacky layer.

These and other features, advantages, and objects of the present disclosure will be further understood and appreciated by those skilled in the art by reference to the following specification, claims, and appended drawings.

Figure 1:
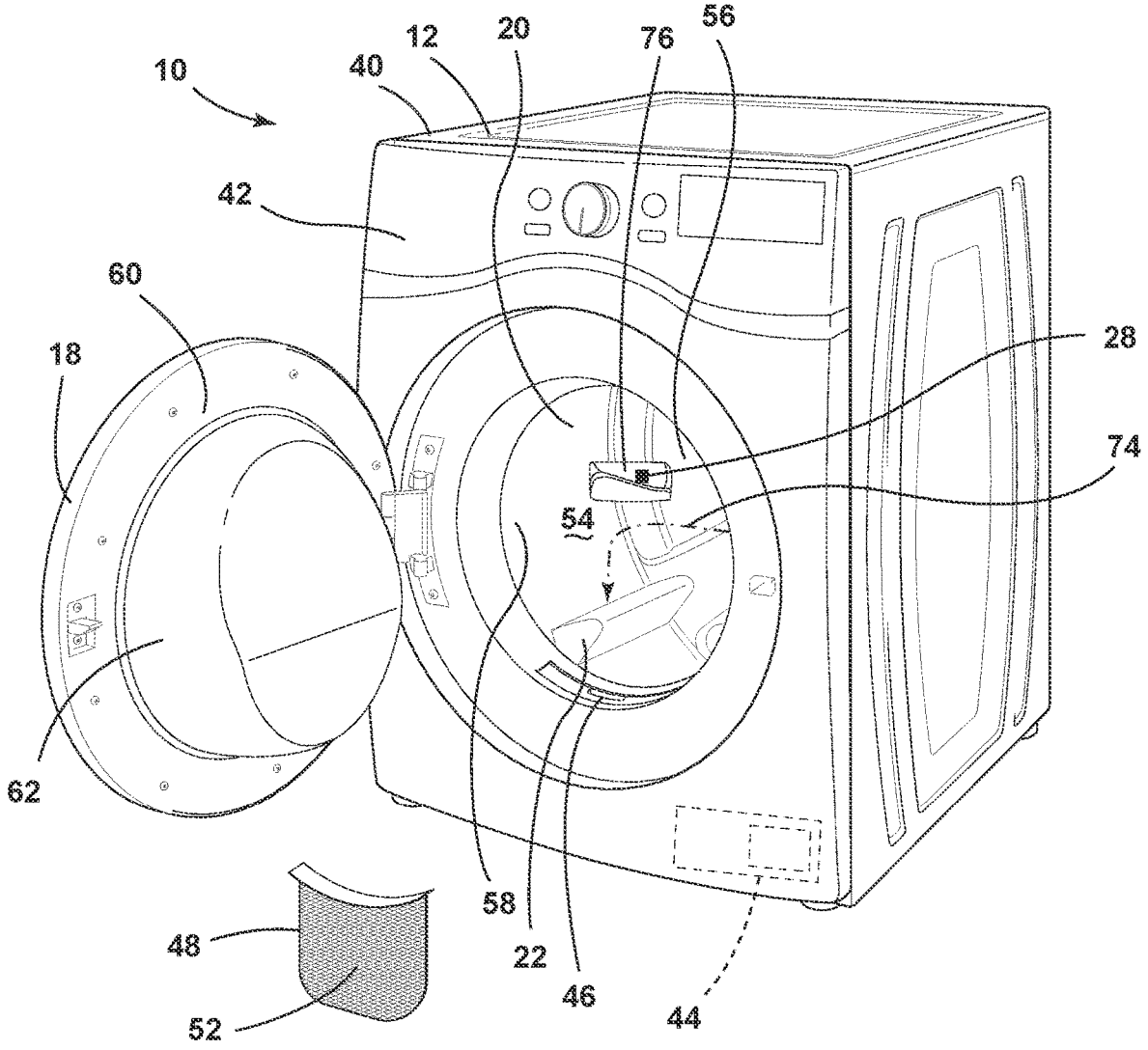
FIG. 1 is a top side perspective view of a laundry appliance of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a foreign particulate collector. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-12, reference numeral 10 generally designates a laundry appliance including a cabinet 12 that defines an opening 14. A door 16 is operably coupled to the cabinet 12 proximate to the opening 14. A drum 18 is disposed within the cabinet 12 and defines a processing space 20. The drum 18 also includes baffles 22. A foreign particulate collector 24 is operably coupled to and selectively removable from at least one of the door 16 and the drum 18. The foreign particulate collector 24 includes a collection material 26 configured to collect foreign particulates 28 within the processing space 20 defined by the drum 18.

Figure 2:
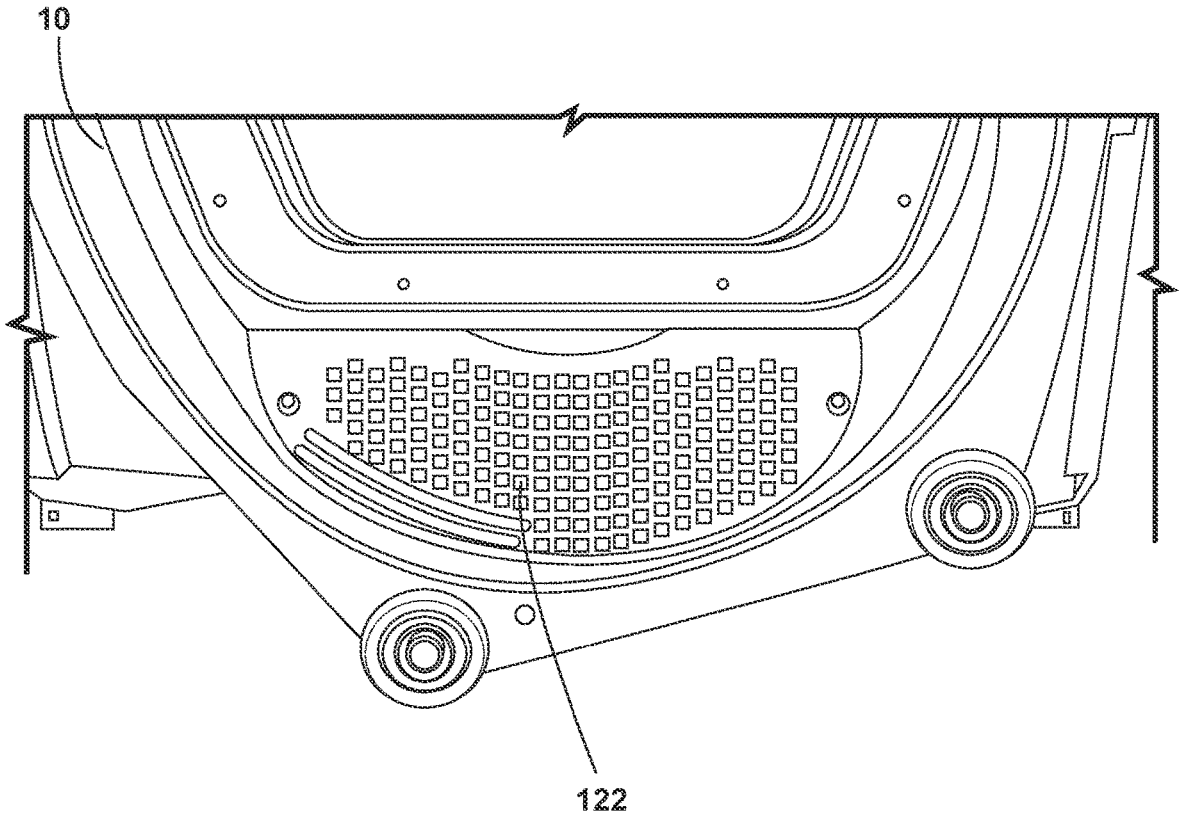
FIG. 2 is an enlarged partial perspective view of a front grille of the laundry appliance of FIG. 1.
Figure 3:
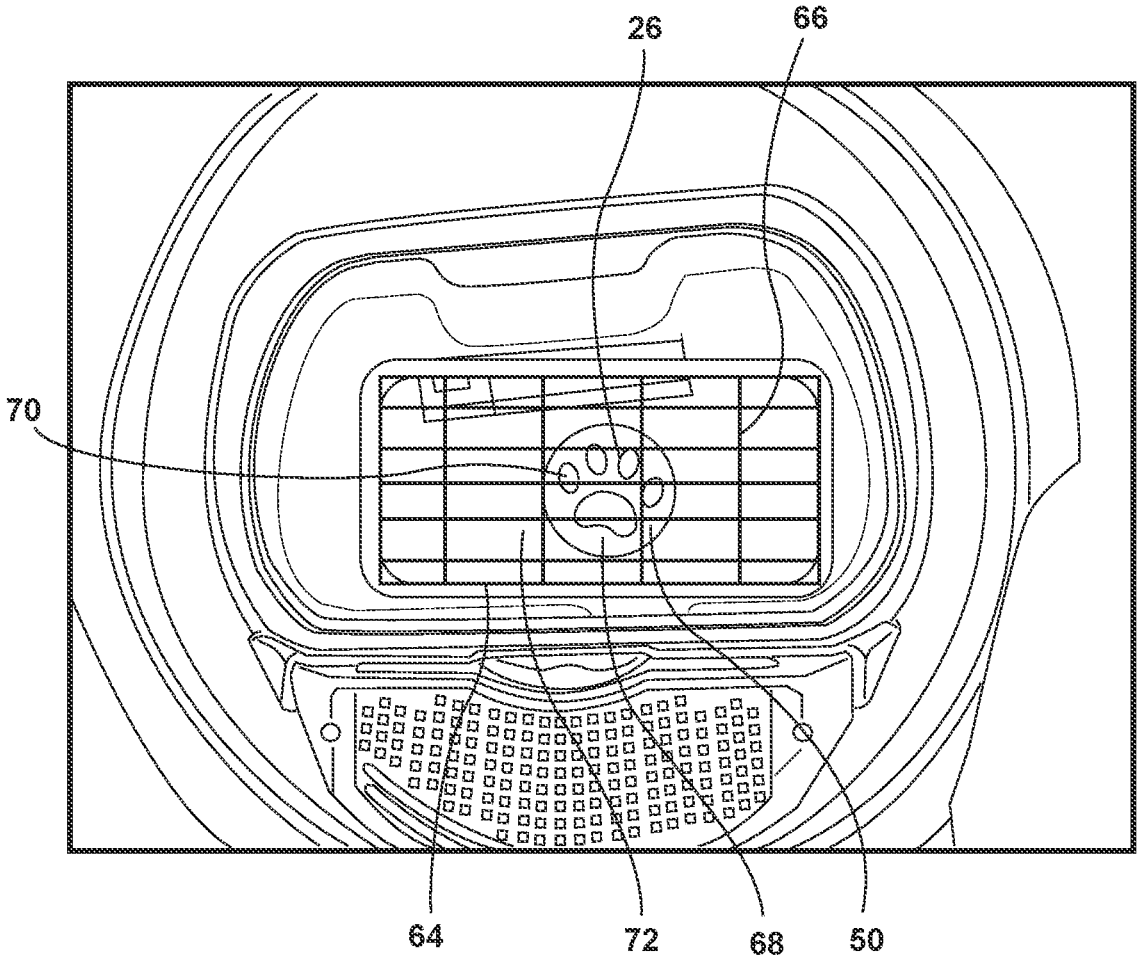
FIG. 3 is an enlarged partial perspective view of a foreign particulate collector of the present disclosure coupled to a door.

Referring to FIGS. 1-3, the laundry appliance 10 is illustrated as a laundry dryer. It is also contemplated that the laundry appliance 10 may be configured as any one of a washer, a dryer, and/or a combination washer and dryer. The cabinet 12 is illustrated as having an outer shell 40, including a front panel 42 to which the door 16 is coupled, in which a machine compartment 44 is disposed. It is also contemplated that the cabinet 12 defines a slot 46 proximate to the door 16 and the opening 14 in which a lint filter 48 may be selectively disposed. The lint filter 48 may collect foreign particulates 28. As discussed in more detail below, the foreign particulate collector 24 may include a first foreign particulate collector 50 and a second foreign particulate collector 52. By way of example, not limitation, the lint filter 48 may be configured as the second foreign particulate collector 52 in some configurations.

The drum 18 includes the baffles 22 operably coupled to sidewalls 54 of the drum 18. The drum 18 is positioned within the cabinet 12 proximate to the opening 14. It is also contemplated that the drum 18 is proximate to a rear wall 56 of the laundry appliance 10. Additionally or alternatively, the rear wall 56 of the laundry appliance 10 may be coupled to the drum 18. As described further herein, the foreign particulate collector 24 may be coupled to or integrally formed with any one of the drum 18, the rear wall 56, and/or the door 16 of the laundry appliance 10.

Referring still to FIGS. 1-3, the door 16 is illustrated as being operably coupled to the front panel 42 of the cabinet 12 proximate to the opening 14. The door 16 may be configured as a flat panel, a fishbowl, and/or any other practicable door for use with the laundry appliance 10. The door 16 is configured to selectively conceal the opening 14 between an open position and a closed position. Stated differently, the door 16 may provide selective access to the processing space 20 via the opening 14. The door 16 includes a peripheral rim 60 disposed around a central body 62. The peripheral rim 60 is selectively and operably coupled to the cabinet 12, and the central body 62 is selectively disposed within the opening 14 in the closed position of the door 16. It is generally contemplated that the central body 62 may be formed from a plastic transparent material and/or any other practicable material, such as metals, to construct the door 16.

With further reference to FIGS. 1-3, a housing 64 is operably coupled to the central body 62 of the door 16. It is generally contemplated that the housing 64 is configured to receive the foreign particulate collector 24, such that the housing 64 defines a central cavity 66 in which the foreign particulate collector 24 may be disposed. The housing 64 may be comprised of a heat resistant plastic and/or other heat resistant material generally practicable for use proximate to the processing space 20 during operation of the laundry cycle. As illustrated in FIG. 3, the foreign particulate collector 24 includes a collection feature 68 that can be disposed within the housing 64.

It is generally contemplated that the collection feature 68 may be selectively removed from the housing 64 and repositioned within the housing 64 after a cleaning process of the collection feature 68. By way of example, not limitation, the collection feature 68 is configured to collect the foreign particulates 28 within the processing space 20. The collection feature 68 includes the collection material 26 of the foreign particulate collector 24, which is configured to attract and retain the foreign particulates 28. It is generally contemplated that the collection material 26 may be a sticky material, a tacky surface, abrasive fabric, and/or other collection materials practicable for removing and collecting the foreign particulates 28. The user may remove the collection feature 68 from the housing 64 to clean or otherwise remove the foreign particulates 28 from the foreign particulate collector 24 once the collection feature 68 appears to be fully saturated with foreign particulates 28. As illustrated in FIG. 3, the collection feature 68 may have a circular shape with an indicia 70 that indicates that the collection feature 68 is configured to collect the foreign particulates 28, such as pet hair. For example, the foreign particulate collector 24 illustrated in FIG. 3 includes a paw-print indicia 70 to indicate that pet hair may be collected by the foreign particulate collector 24. It is also contemplated that the collection feature 68 may include other indicia 70 to indicate various uses and may have any shape practicable for collecting the foreign particulates 28.

With further reference to FIGS. 1-3, the foreign particulates 28 can accumulate along the collection material 26 of the collection feature 68, such that the foreign particulates 28 are retained on the collection feature 68 via the collection material 26. The collection material 26 is contemplated to be compatible with water or other liquids to assist in the removal of the foreign particulates 28 from the collection feature 68. In this manner, the collection feature 68 is typically a cleanable member that can be reused for a plurality of laundry cycles. The collection material 26 of the foreign particulate collector 24 can configured to remain sticky or otherwise tacky after cleaning and removal of the foreign particulates 28 from the collection feature 68. Additionally or alternatively, the collection material 26 may be an abrasive fabric that may be cleaned of the foreign particulates 28 to be reused. In either configuration, the collection feature 68 may be removed from the housing 64 after the foreign particulates 28 have accumulated on the collection material 26 to be cleaned, and subsequently disposed back into the housing 64 for continued and repeated use. When wetted, the collection feature 68 has diminished adhesive properties for cleaning. When dry, the collection feature 68 exhibits the adhesive features needed to collect the foreign particulates 28.

As illustrated in FIGS. 2 and 3, the housing 64 includes a plurality of apertures 72 that receive the foreign particulates 28 from the processing space 20. Additionally or alternatively, the housing 64 may include slots and/or other openings configured to receive the foreign particulates 28 from the processing space 20. A blower moves process air 74 through an airflow path that includes the processing space 20. The process air 74 directs the foreign particulates 28 toward the housing 64 during the laundry cycle. The flow of process air 74 may assist in removing the foreign particulates 28 from clothing items 76 to be collected by the foreign particulate collector 24.

Referring now to FIGS. 1 and 4-6, the foreign particulate collector 24 includes a plurality of layers 80 that are removably coupled to one another via the collection material 26. Stated differently, the foreign particulate collector 24 includes a plurality of removable layers 80. It is contemplated that the plurality of layers 80 may be disposed on the central body 62 of the door 16 proximate to the opening 14 defined by the cabinet 12. Each layer 80 includes the collection material 26 of the foreign particulate collector 24, such that an outermost layer 82 is configured to collect the foreign particulates 28 within the processing space 20. Each of the plurality of layers 80 defines a contact surface 84 which intermittently contacts the clothing items 76. The clothing items 76 tumble within the processing space 20 and may contact the contact surface 84 of the foreign particulate collector 24. The contact between the contact surface 84 and the clothing items 76 assists in releasing and removing the foreign particulates 28 from the clothing items 76.

Each layer 80 has a first side 86 and a second side 88, and it is generally contemplated that the first side 86 includes the collection material 26 of the foreign particulate collector 24. The second side 88 may be laminated or otherwise coated. The coating of the second side 88 assists in selectively removing the outermost layer 82 from the collection material 26 of the first side 86 of an adjacent layer 90. Stated differently, the second side 88 of a first layer 92 of the foreign particulate collector 24 is removably coupled with the first side 86 of a second layer 94 of the foreign particulate collector 24. The first layer 92 is configured with the collection material 26 to selectively retain the adjacent layer 90. Each layer 80 is selectively removable to provide a clean layer 80 of the collection material 26 to collect the foreign particulates 28 within the processing space 20.

Referring still to FIGS. 1 and 4-6, it is generally contemplated that the plurality of layers 80 of the foreign particulate collector 24 may be coupled to the door 16 via magnets, clips, snaps, adhesives, and/or other methods of coupling. The selective removal of each of the plurality of layers 80 assists the user in removing the foreign particulates 28 from the processing space 20. The user can selectively remove the visible, outermost layer 82 of the plurality of layers 80 when the foreign particulates 28 have accumulated on the outermost layer 82.

Figure 4:
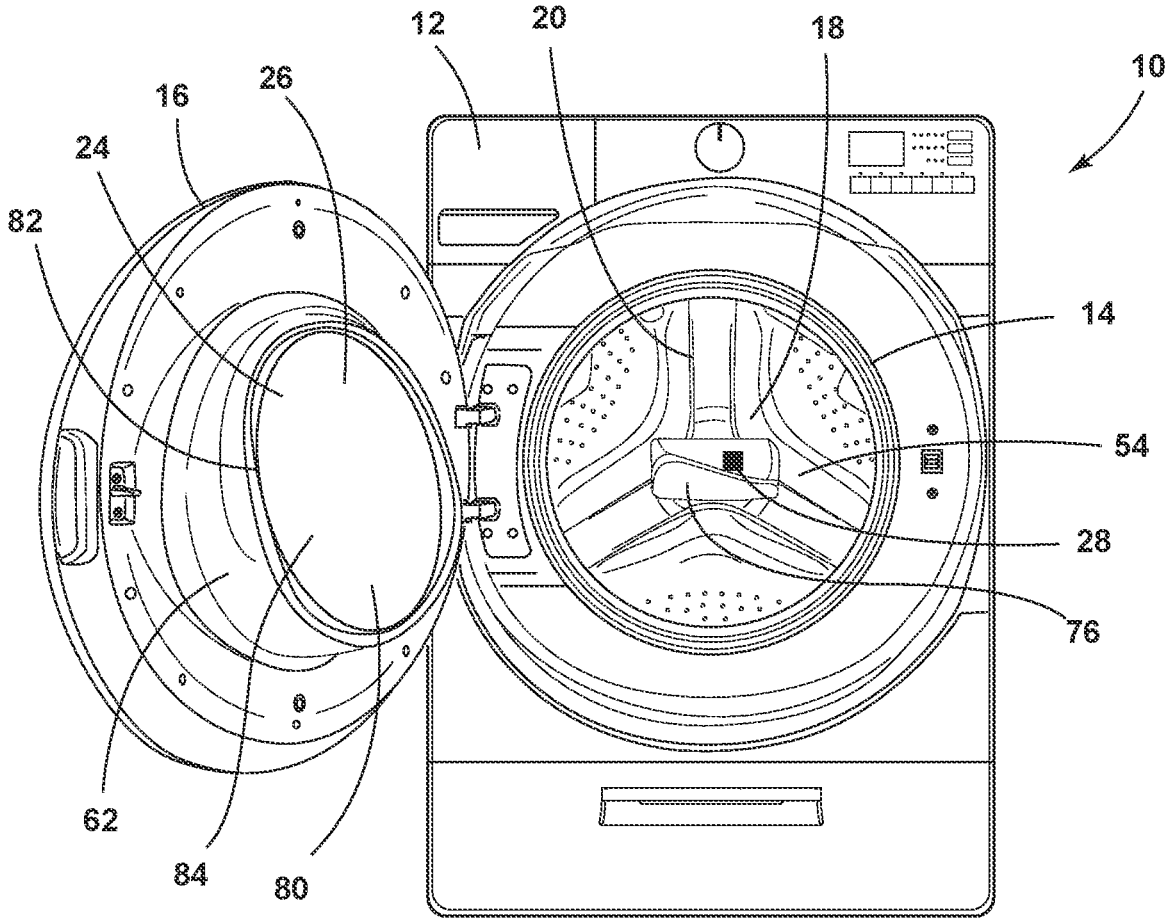
FIG. 4 is a front elevational view of a laundry appliance with a foreign particulate collector of the present disclosure coupled to a door of the laundry appliance.
Figure 5:
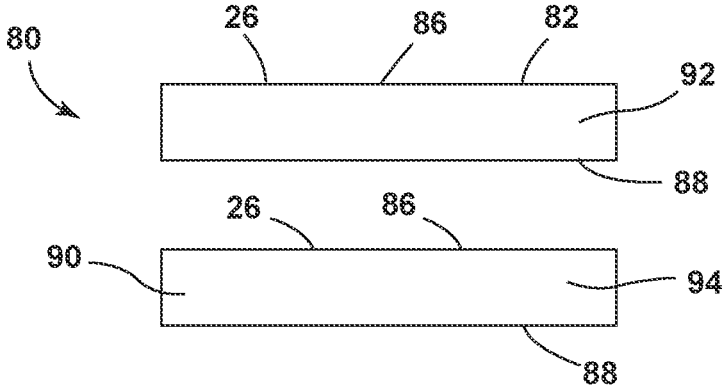
FIG. 5 is a schematic view of a foreign particulate collector of the present disclosure including a plurality of layers.
Figure 6:
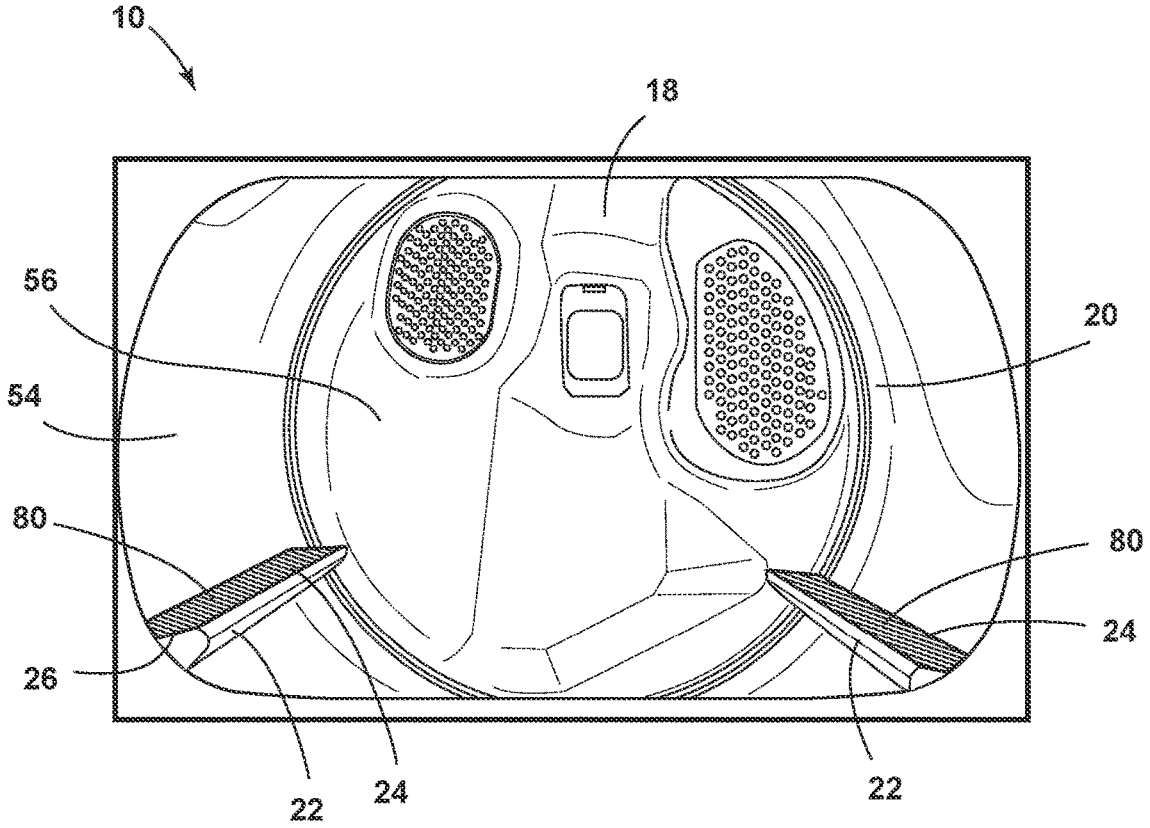
FIG. 6 is an enlarged partial perspective view of a drum with a foreign particulate collector of the present disclosure coupled to baffles in the drum.

While FIG. 4 depicts the plurality of layers 80 being coupled to the door 16, it is also contemplated that the plurality of layers 80 may be operably coupled to the sidewalls 54 of the drum 18 and/or the baffles 22 of the drum 18. For example, FIG. 6 depicts the foreign particulate collector 24 with the plurality of layers 80 on the baffles 22. Regardless of the placement of the foreign particulate collector 24, the plurality of layers 80 selectively remove the foreign particulates 28 from the clothing items 76 during a laundry cycle. Stated differently, the foreign particulate collector 24 disposed on the baffles 22 may include the plurality of layers 80, such that each layer 80 may be selectively removed upon completion of the laundry cycle for removal of the foreign particulates 28. The position of the foreign particulate collector 24 on the baffles 22 maximizes the contact with the clothing items 76 to assist in removing and collecting the foreign particulates 28.

Figure 7:
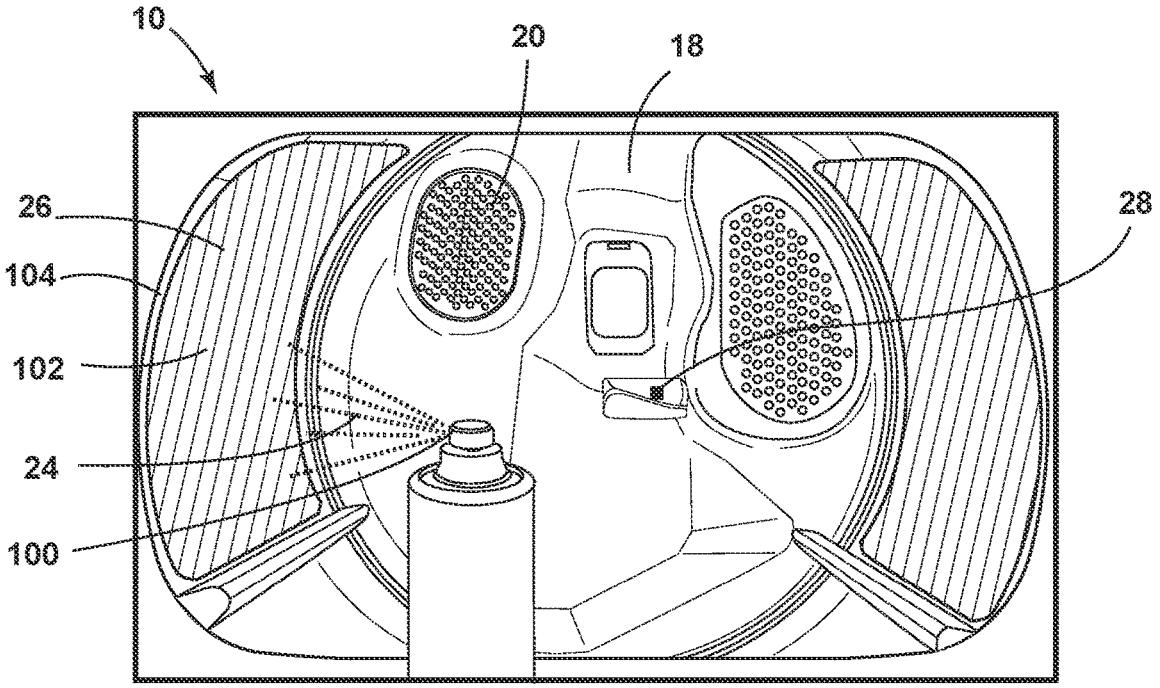
FIG. 7 is an enlarged partial perspective view of a drum with a foreign particulate collector of the present disclosure in the form of a consumable spray.
Figure 8:
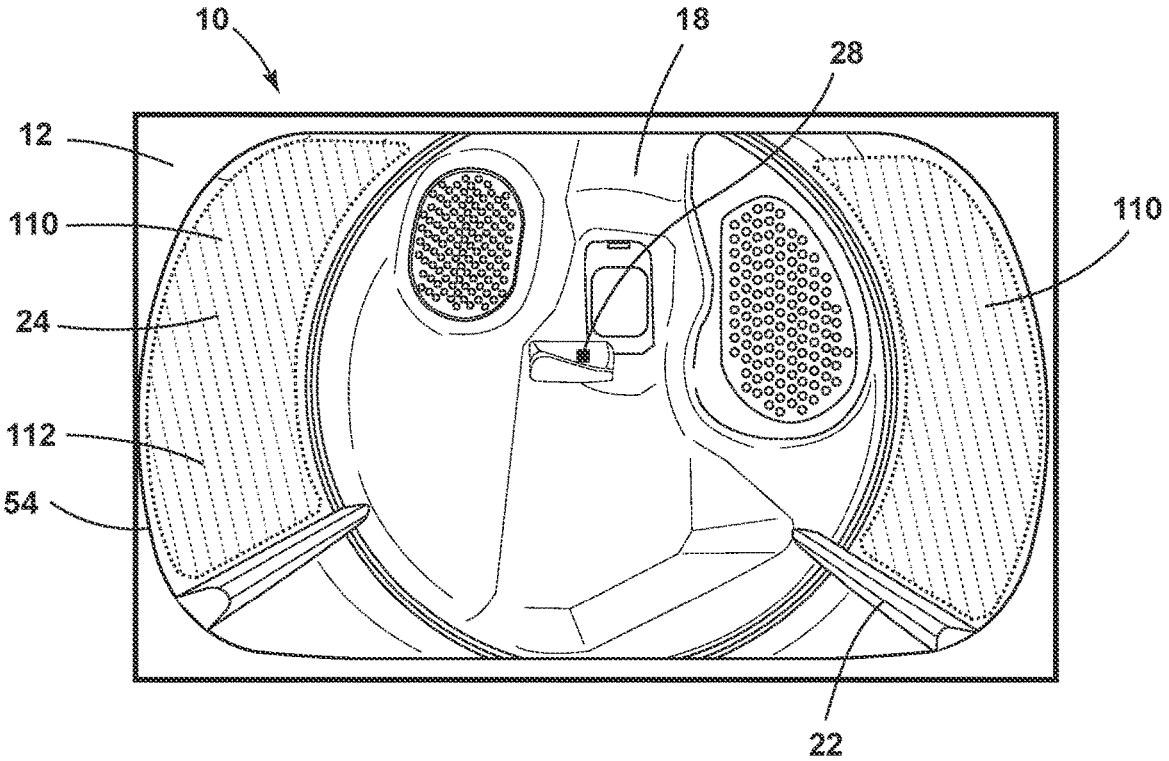
FIG. 8 is an enlarged partial perspective view of a drum of a laundry appliance with a foreign particulate collector of the present disclosure with removable pads coupled to the drum.

With reference now to FIGS. 7 and 8, the foreign particulate collector 24 may be a consumable spray 100. The collection material 26 may be integrated in the consumable spray 100 as an adhesive. The consumable spray 100 provides an adhesive surface 102 that is applied to an application surface 104. By way of example, not limitation, the application surface 104 may be the sidewalls 54 of the drum 18 and/or the central body 62 of the door 16. The adhesive surface 102 is configured to capture the foreign particulates 28 within the drum 18 on the collection material 26. The clothing items 76 contact the adhesive surface 102 during the laundry cycle, and the foreign particulates 28 may be trapped on the adhesive surface 102. It is generally contemplated that the adhesive surface 102 may be removed after the laundry cycle is complete. For example, the adhesive surface 102 may be peeled, wiped and/or vacuumed off of the application surface 104. The adhesive surface 102 may subsequently be reapplied via the consumable spray 100 for an upcoming laundry cycle.

Alternatively, the consumable spray 100 may be disposed upon a removable pad 110, such that the consumable spray 100 can dispose the adhesive surface 102 on the removable pad 110. The removable pad 110 may then be disposed on the application surface 104, such as within the drum 18, to trap the foreign particulates 28. For example, the removable pads 110 may be operably coupled to the sidewalls 54 of the drum 18 via magnets, clips, snaps, adhesive, and/or other practicable coupling methods. It is also contemplated that the removable pads 110 may be operably coupled to the baffles 22 and/or the door 16 (FIG. 4) proximate to the opening 14 of the cabinet 12.

Referring now to FIG. 8, the removable pad 110 is illustrated as the foreign particulate collector 24. The removable pad 110 may include the collection material 26 integrally formed with a collection surface 112 on which the foreign particulates 28 may be collected. The collection material 26 is disposed along the collection surface 112 of the removable pad 110 to remove the foreign particulates 28 from the clothing items 76 within the drum 18. It is also contemplated that the removable pad 110 is configured to be washable as the removable pad 110 is removably coupled to the laundry appliance 10. For example, the removable pad 110 may be removed from the drum 18 once the collection surface 112 is filled with the foreign particulates 28. The removable pad 110 may be washed via a separate laundry machine and/or by hand by the user. For example, the user may rinse the mat with a liquid to remove the foreign particulates 28 outside of the laundry appliance 10. It is contemplated that the removable pad 110 can be operably coupled to the sidewalls 54 of the drum 18 via magnets and/or other coupling features to assist in the selective and operable removal from the sidewalls 54.

Figure 9:
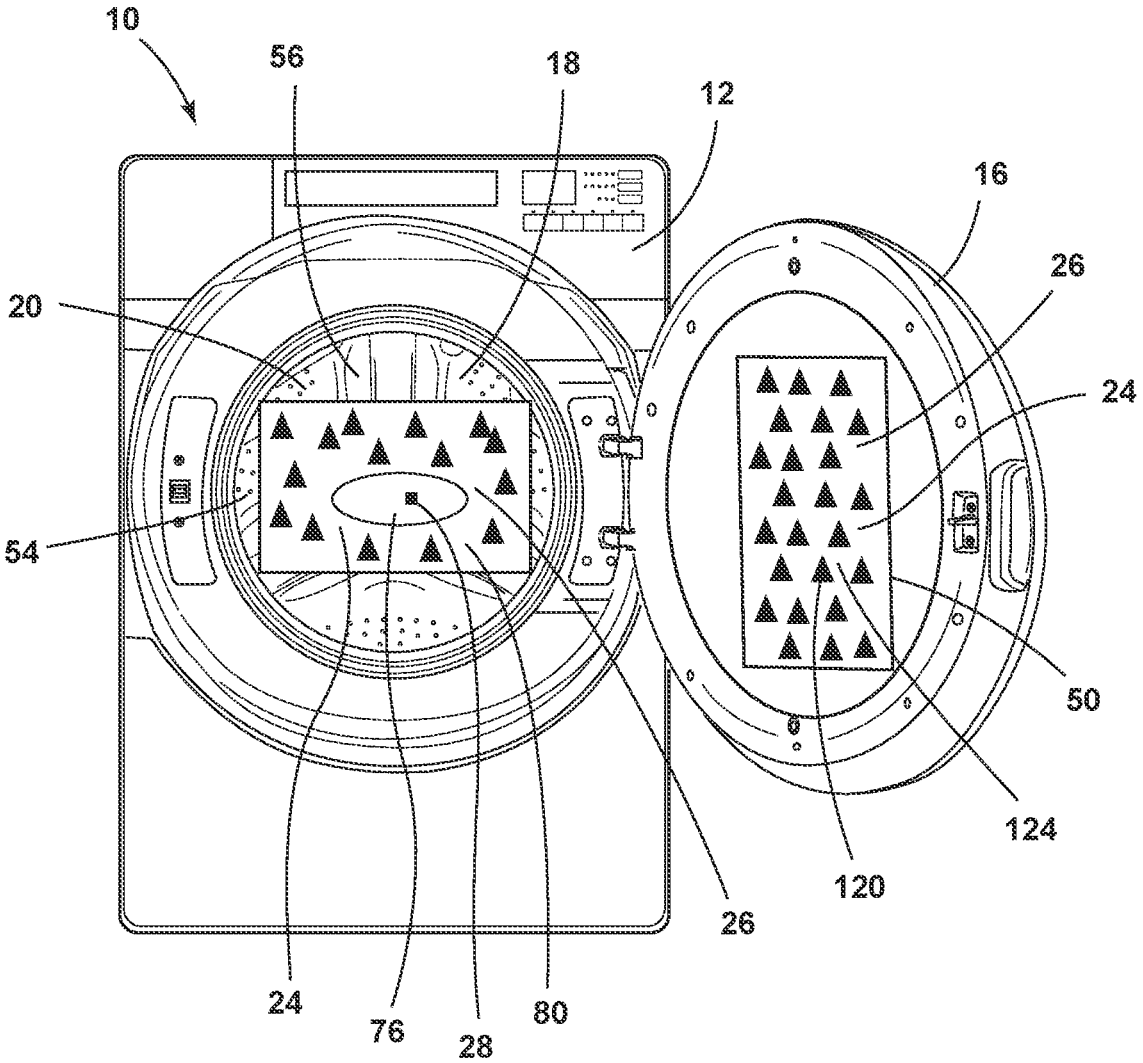
FIG. 9 is a front perspective view of a laundry appliance with a first foreign particulate collector and a second foreign particulate collector of the present disclosure.
Figure 10:
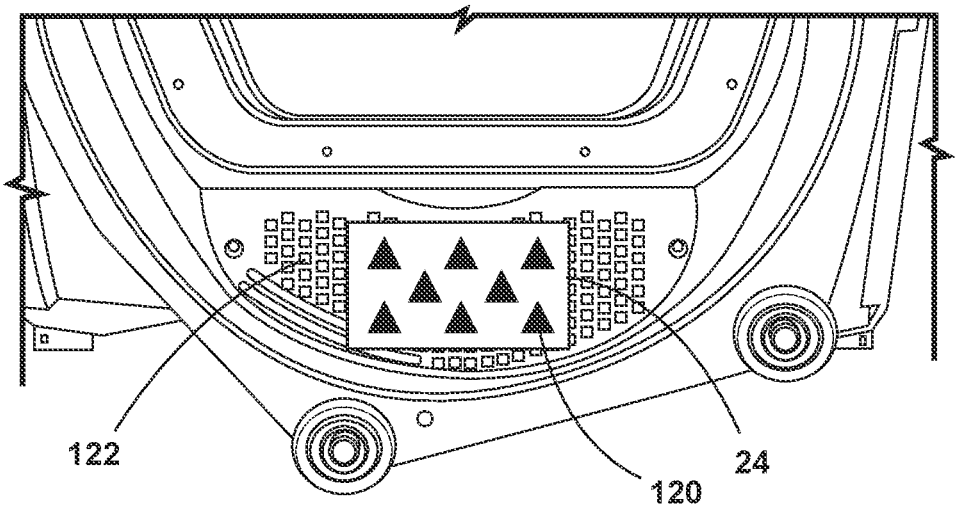
FIG. 10 is an enlarged partial perspective view of a foreign substrate collector of the present disclosure coupled to a front grille of a laundry appliance.
Figure 11:
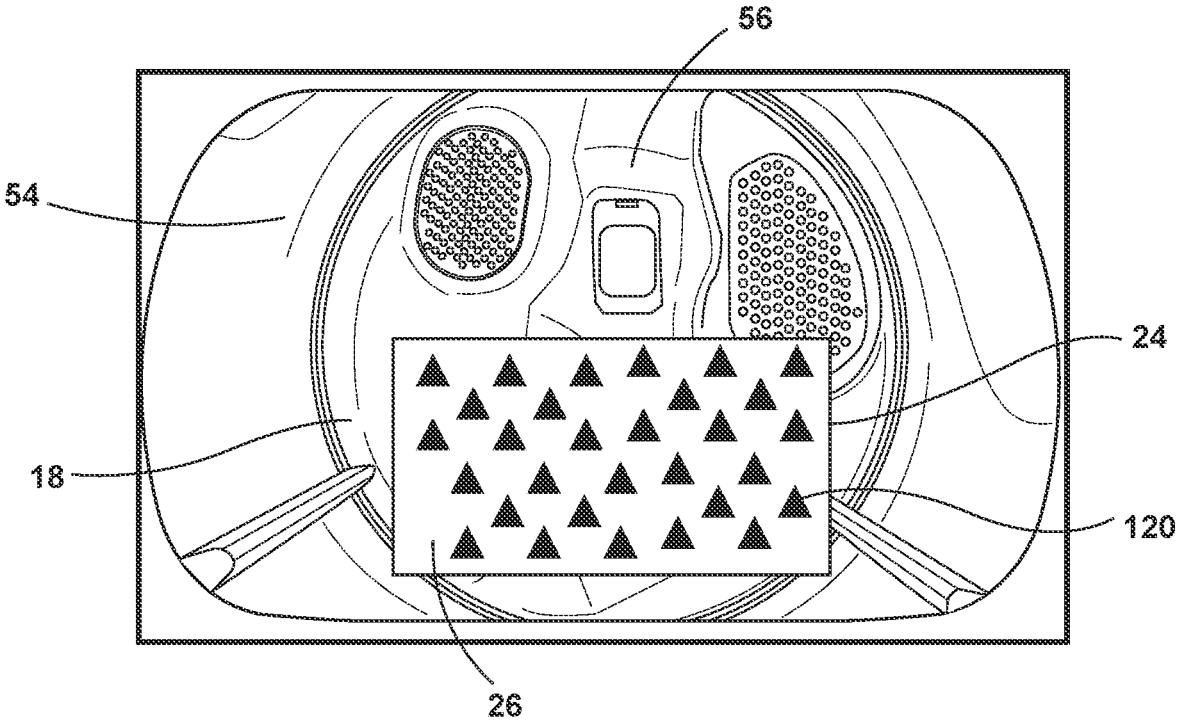
FIG. 11 is an enlarged partial perspective view of a foreign substrate collector of the present disclosure coupled to a rear wall of a laundry appliance.

With reference to FIGS. 9-11, the foreign particulate collector 24 may include a plurality of projections 120 extending from the collection material 26. As described herein, the foreign particulate collector 24 may be operably coupled to any one of the drum 18, the door 16, the sidewalls 54 of the drum 18, and/or the rear wall 56 of the laundry appliance 10. It is also contemplated that the foreign particulate collector 24 may be coupled to a grill or ventilation plate 122 (FIG. 2) of the laundry appliance 10 proximate to the lint filter 48 (FIG. 1).

The ventilation plate 122 defines an inner surface of the door 16 and is exposed to the processing space 20 when the door 16 is in a closed position. The collection feature 68 is positioned within the door 16, such as behind the ventilation plate 122. In this manner, the ventilation plate 122 defines a communication between the processing space 20 and the collection feature 68. The housing 64 can include an access panel that is operable to provide access to the collection feature 68. In certain aspects of the device, the ventilation plate 122 can operate as an access panel. It is also contemplated that the ventilation plate 122 can include a slot 46 or other opening 14 that allows the collection feature 68 to be inserted and removed from the door 16. As illustrated in FIG. 9, the first foreign particulate collector 50 may be operably coupled to the door 16, and the second foreign particulate collector 52 may be operably coupled to the rear wall 56 of the laundry appliance 10. Additionally, as exemplified in FIG. 2, the ventilation plate 122 can be positioned below a viewing window of the door 16.

The projections 120 outwardly extend from the collection material 26 of each of the first and second foreign particulate collectors 50, 52 and are configured to engage and gently agitate the clothing items 76 within the processing space 20. The gentle engagement of the projections 120 assists in removal, and potentially capture, of the foreign particulates 28 from the clothing items 76. For example, the projections 120 may be configured as spikes and/or rounded protrusions extending from the collection material 26 to assist in releasing the foreign particulates 28 from the clothing items 76. The foreign particulate collector 24 may include both spiked projections 120 and rounded projections 120 to provide a varied surface 124 along the foreign particulate collector 24. The varied surface 124 may further assist in the removal of the foreign particulates 28 from the clothing items 76.

With further reference to FIGS. 9-11, it is generally contemplated that the projections 120 may be formed from a generally flexible material, such that the projections 120 can gently engage the clothing items 76 within the processing space 20. The projections 120 may flex and bend to minimize potential abrasive contact with the clothing items 76. It is also contemplated that the process air 74 (FIG. 1) within the processing space 20 may assist in directing any remaining foreign particulates 28 toward either the foreign particulate collector 24 disposed on the door 16 and/or the lint filter 48 configured to collect any remaining foreign particulates 28.

In any one of these configurations, the foreign particulate collector 24 is configured to be selectively removable from the laundry appliance 10 to assist in cleaning and maintenance of the foreign particulate collectors 24. It is also contemplated that the foreign particulate collectors 24 illustrated in FIGS. 9-11 may include the plurality of layers 80 described herein. It is generally contemplated that the plurality of layers 80 may be configured as removable tacky layers or removable sticky layers with a dedicated set of the projections 120, incorporated into each layer 80. Accordingly, the first side 86 includes both the collection material 26 and the projections 120. Each layer 80 may be selectively removed to reveal a new set of projections 120 and collection material 26 along the first side 86 of the layer 80.

Figure 12:
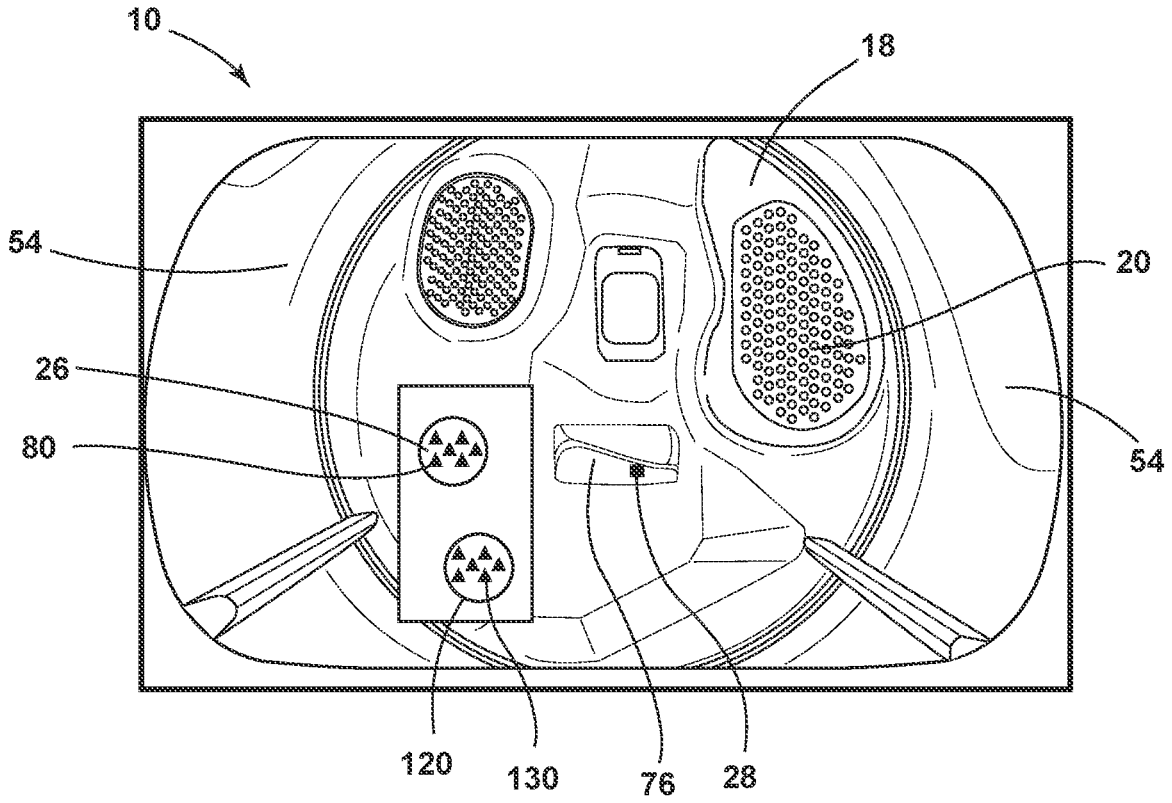
FIG. 12 is an enlarged partial perspective view of a foreign substrate collector of the present disclosure disposed within a laundry cavity of a laundry appliance.
Figure 13:
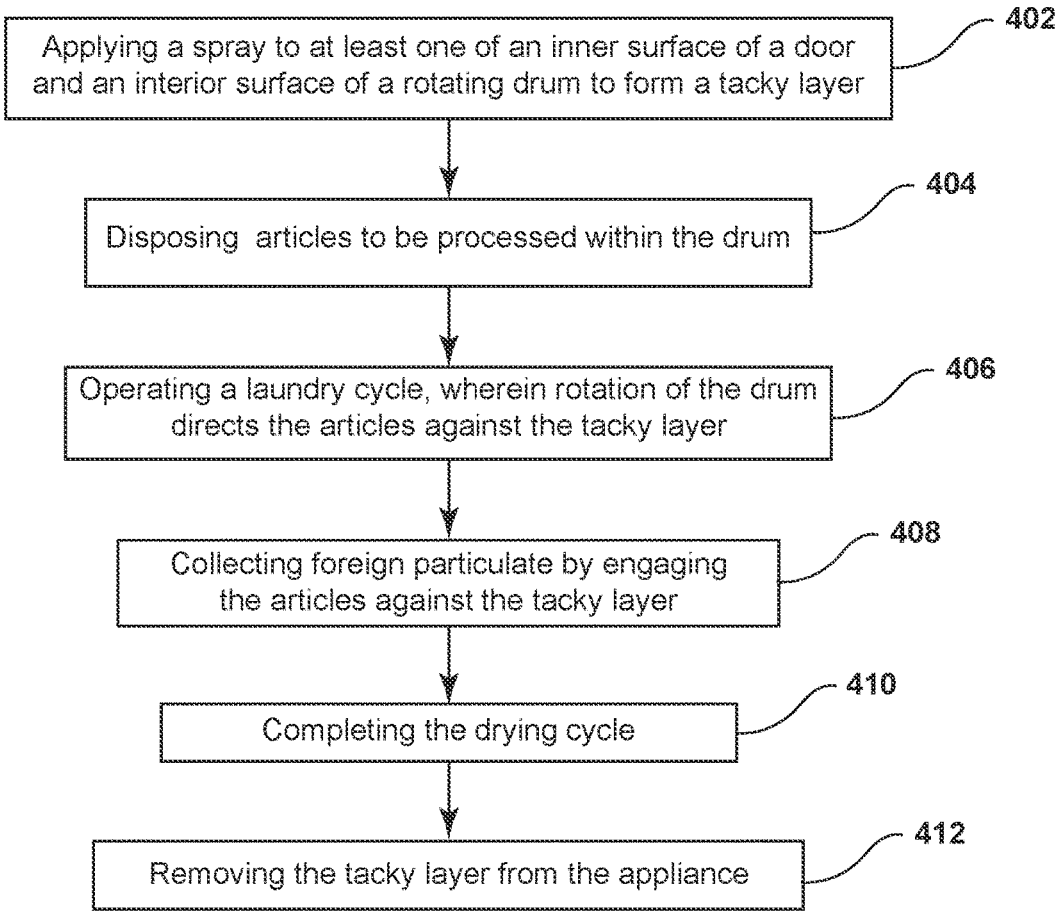
FIG. 13 is a linear flow diagram illustrating a method for collecting particulate during performance of a laundry cycle.
Figure 14:
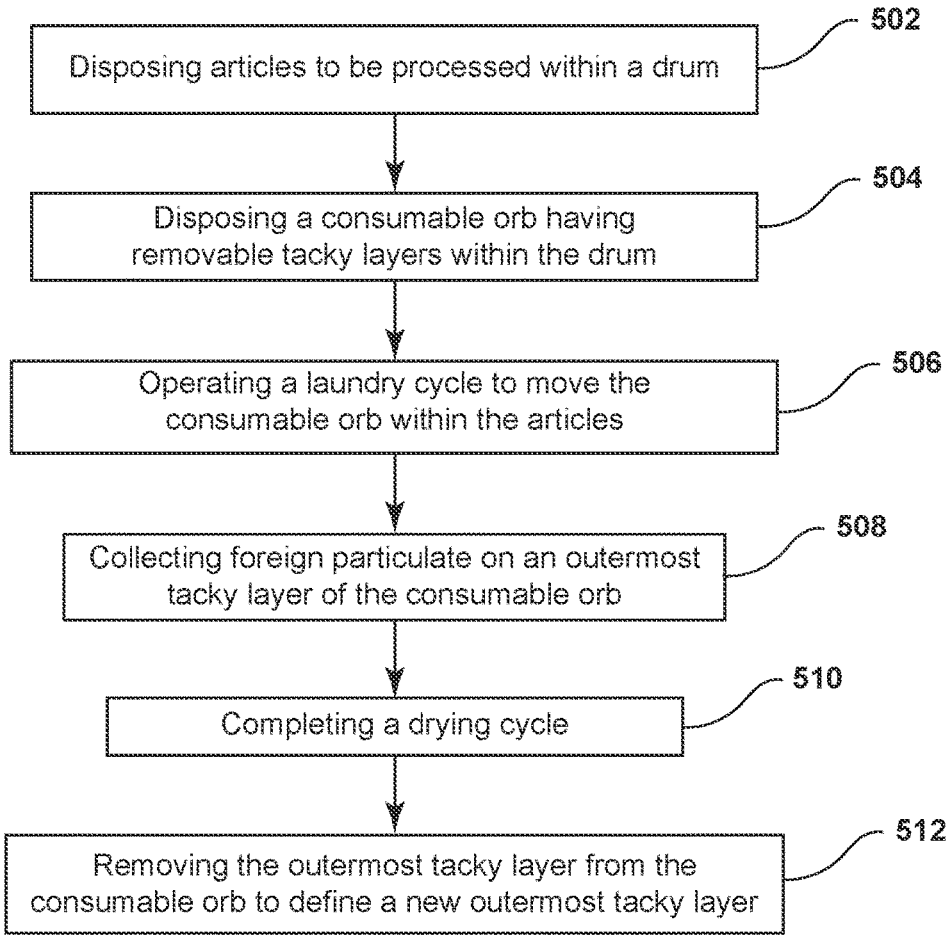
FIG. 14 is a linear flow diagram illustrating a method for collecting particulate during performance of a laundry cycle.

With reference now to FIG. 12, the foreign particulate collector 24 may be alternately configured as a ball 130, such as a consumable orb, having the plurality of layers 80 and/or the projections 120 that are layered around a central core. It is generally contemplated that the balls 130 are formed from the collection material 26. Like the other configurations described herein, the balls 130 are configured to collect the foreign particulates 28 within the processing space 20 during a laundry cycle via gentle engagement with the clothing items 76. At least one ball 130 is disposed within the processing space 20 during the laundry cycle. The ball 130 rotates around the drum 18 with the clothing items 76 to collect the foreign particulates 28. The rotation of the ball 130 and the clothing items 76 within the drum 18 maximizes the contact between the clothing items 76 and the ball 130 to collect the foreign particulates 28.

For example, the balls 130 may access portions of the clothing items 76 that may be set apart from the sidewalls 54 of the drum 18, such that the balls 130 access a concealed portion of the clothing items 76 relative to the sidewalls 54 of the drum 18. It is also contemplated that multiple configurations of the foreign particulate collector 24, as described herein may be utilized in various combinations. For example, the clothing items 76 may gently engage the first foreign particulate collector 50 on the sidewalls 54 of the drum 18 and the second foreign particulate collector 52 configured as the ball 130 within the processing space 20. The maximized contact between the multiple foreign particulate collectors 24 assists in the maximal removal of the foreign particulates 28 from the clothing items 76.

Referring now to FIGS. 1-13, having described various aspects of the device, a method 400 is disclosed for collecting foreign particulates 28 during performance of a laundry cycle. This method 400 includes a step 402 of applying an adhesive spray that forms an adhesive surface 102 on at least one of an inner surface of a door 16 and an interior surface 58 of a rotating drum 18 for a laundry appliance 10 to form a tacky layer. A step 404 includes disposing articles, such as clothing items 76, to be processed within the drum 18. Step 406 includes operating a laundry cycle, wherein rotation of the drum 18 directs the clothing items 76 against the tacky layer. Step 408 includes collecting foreign particulates 28 using the tacky layer. Step 410 includes completing the drying cycle. Step 412 includes removing the tacky layer from the appliance 10. This sprayed on tacky layer is configured to typically be used for a single drying cycle or a small number of drying cycles. After this use, the tacky layer can be peeled or otherwise removed from the appliance 10 for disposal.

Referring now to FIGS. 1-12 and 14, having described various aspects of the device, a method 500 is a method for collecting foreign particulates 28 during performance of a laundry cycle of a laundry appliance 10. According to the method 500, step 502 includes disposing articles, such as clothing items 76 to be processed within a drum 18. Step 504 includes disposing a consumable orb 130 within the drum 18. As described herein, the consumable orb 130 includes a plurality of disposable tacky layers that can be peeled off as the consumable orb 130 is used. Step 506 includes operating a laundry cycle, wherein rotation of the drum 18 moves the consumable orb 130 within the articles. Step 508 includes collecting foreign particulate 28, wherein engagement of the articles with an outermost tacky layer of the plurality of disposable tacky layers transfers the foreign particulate 28 from the articles to the outermost tacky layer. Step 510 includes completing a drying cycle. Step 512 of the method 500 includes removing the outermost tacky layer from the consumable orb 130 to define a new outermost tacky layer.

Referring again to FIGS. 1-14, the foreign particulate collector 24 advantageously assists in removing foreign particulates 28 from the clothing items 76 in the drum 18.

The selective removability of the foreign particulate collector 24 assists in maintaining a clean surface with which the clothing items 76 may engage. The inclusion of the collection material 26 assists in grabbing and retaining the foreign particulates 28 to assist in removal from the clothing items 76. The projections 120 may further assist in gently agitating the clothing items 76 to release the foreign particulates 28. Overall, the foreign particulate collector 24 maximizes the removal of foreign particulates 28 from the clothing items 76 within the processing space 20, regardless of the configuration.

The invention disclosed herein is further summarized in the following paragraphs and is further characterized by combinations of any and all of the various aspects described therein.

According to another aspect of the present disclosure, a laundry appliance includes a cabinet defining an opening. A drum is disposed within the cabinet and defines a processing space. A blower directs process air through an airflow path that includes the drum. A door is operably coupled to the cabinet. The door is operable to an open position that provides selective access through the opening and into the drum. A foreign particulate collector is operably coupled to the door. The foreign particulate collector includes a collection material configured to collect foreign particulates within the drum.

According to another aspect, the foreign particulate collector includes a housing operably coupled to the door and a collection feature selectively disposed within the housing.

According to yet another aspect, the door includes a central body and the housing is attached to the central body. The door, the housing and the drum define the processing space for treating clothing items.

According to another aspect of the present disclosure, the foreign particulate collector includes the collection feature that is disposed within the housing. The drum and the blower operate to direct the process air through the housing and along the collection feature.

According to another aspect, the collection feature includes a tacky surface.

According to yet another aspect, the collection feature of the foreign particulate collector includes projections extending from the tacky surface.

According to another aspect of the present disclosure, the housing includes a ventilation plate that defines an inner surface of the door that is exposed to the processing space in a closed position. The collection feature is positioned within the door and the ventilation plate provides communication between the drum and the collection feature.

According to another aspect, the ventilation plate is positioned below a window disposed within the door.

According to yet another aspect, the housing includes an access panel that is operable to remove the collection feature from the door.

According to another aspect of the present disclosure, the collection feature is a cleanable member that can be removed from the housing for cleaning and replacement within the housing.

According to another aspect, the foreign particulate collector is attached to an inner surface of the door. The foreign particulate collector defines a portion of the processing space when the door is in the closed position.

According to yet another aspect, the foreign particulate collector includes one of a tacky surface and a plurality of projections.

According to another aspect of the present disclosure, the foreign particulate collector includes the tacky surface, wherein the tacky surface is defined within a plurality of removable tacky layers.

According to another aspect, each of the removable tacky layers includes a dedicated set of projections.

According to yet another aspect, operation of the drum manipulates articles in the drum to engage at least a portion of the foreign particulate collector.

According to another aspect of the present disclosure, a method for collecting particulate during performance of a laundry cycle of a laundry appliance includes applying a spray to at least one of an inner surface of a door and an interior surface of a rotating drum for a laundry appliance. The spray defines a tacky layer. Articles to be processed are disposed within the drum. A laundry cycle is operated, where rotation of the drum directs the articles against the tacky layer. Foreign particulate is collected, where engagement of the articles with the tacky layer transfers the foreign particulate from the articles to the tacky layer. The laundry cycle is completed. The tacky layer is removed from the appliance.

According to another aspect, the spray is disposed on a removable pad that is selectively coupled to one of the door and the drum.

According to yet another aspect, the removable pad is selectively attached to a baffle of the drum.

According to another aspect of the present disclosure, a method for collecting particulate during performance of a laundry cycle of a laundry appliance includes disposing articles to be processed within a drum. A consumable orb is disposed within the drum, where the consumable orb includes a plurality of disposable tacky layers. A laundry cycle is operated, where rotation of the drum moves the consumable orb within the articles. Foreign particulate is collected, where engagement of the articles with an outermost tacky layer of the plurality of disposable tacky layers transfers the foreign particulate from the articles to the outermost tacky layer. A drying cycle is completed. The outermost tacky layer is removed from the consumable orb to define a new outermost tacky layer.

According to another aspect, the orb includes a central core that is surrounded by the plurality of disposable tacky layers.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a cabinet defining an opening;

a drum disposed within the cabinet and defining a processing space;

a blower that directs process air through an airflow path that includes the drum;

a door operably coupled to the cabinet, wherein the door is operable to an open position that provides selective access through the opening and into the drum; and a foreign particulate collector operably coupled to the door, the foreign particulate collector including a collection material configured to collect foreign particulates within the drum.

2. The laundry appliance of claim 1, wherein the foreign particulate collector includes a housing operably coupled to the door and a collection feature selectively disposed within the housing.

3. The laundry appliance of claim 2, wherein the door includes a central body and wherein the housing is attached to the central body, wherein the door, the housing and the drum define the processing space for treating clothing items.

4. The laundry appliance of claim 2, wherein the foreign particulate collector includes the collection feature that is disposed within the housing, wherein the drum and the blower operate to direct the process air through the housing and along the collection feature.

5. The laundry appliance of claim 4, wherein the collection feature includes a tacky surface.

6. The laundry appliance of claim 5, wherein the collection feature of the foreign particulate collector includes projections extending from the tacky surface.

7. The laundry appliance of claim 6, wherein the housing includes a ventilation plate that defines an inner surface of the door that is exposed to the processing space in a closed position, wherein the collection feature is positioned within the door and the ventilation plate provides communication between the drum and the collection feature.

8. The laundry appliance of claim 7, wherein the ventilation plate is positioned below a window disposed within the door.

9. The laundry appliance of claim 2, wherein the housing includes an access panel that is operable to remove the collection feature from the door.

10. The laundry appliance of claim 9, wherein the collection feature is a cleanable member that can be removed from the housing for cleaning and replacement within the housing.

11. The laundry appliance of claim 7, wherein the foreign particulate collector is attached to an inner surface of the door, and wherein the foreign particulate collector defines a portion of the processing space when the door is in the closed position.

12. The laundry appliance of claim 11, wherein the foreign particulate collector includes one of a tacky surface and a plurality of projections.

13. The laundry appliance of claim 12, wherein the foreign particulate collector includes the tacky surface, wherein the tacky surface is defined within a plurality of removable tacky layers.

14. The laundry appliance of claim 13, wherein each of the removable tacky layers includes a dedicated set of projections.

15. The laundry appliance of claim 11, wherein operation of the drum manipulates articles in the drum to engage at least a portion of the foreign particulate collector.

16. A method for collecting particulate during performance of a laundry cycle of a laundry appliance, the method including steps of:

applying a spray to at least one of an inner surface of a door and an interior surface of a rotating drum for a laundry appliance, wherein the spray defines a tacky layer;

disposing articles to be processed within the drum;

operating a laundry cycle, wherein rotation of the drum directs the articles against the tacky layer;

collecting foreign particulate, wherein engagement of the articles with the tacky layer transfers the foreign particulate from the articles to the tacky layer;

completing the laundry cycle; and removing the tacky layer from the appliance.

17. The method of claim 16, wherein the spray is disposed on a removable pad that is selectively coupled to one of the door and the drum.

18. The method of claim 17, wherein the removable pad is selectively attached to a baffle of the drum.

19. A method for collecting particulate during performance of a laundry cycle of a laundry appliance, the method including steps of:

disposing articles to be processed within a drum;

disposing a consumable orb within the drum, wherein the consumable orb includes a plurality of disposable tacky layers;

operating a laundry cycle, wherein rotation of the drum moves the consumable orb within the articles;

collecting foreign particulate, wherein engagement of the articles with an outermost tacky layer of the plurality of disposable tacky layers transfers the foreign particulate from the articles to the outermost tacky layer;

completing a drying cycle; and removing the outermost tacky layer from the consumable orb to define a new outermost tacky layer.

20. The method of claim 19, wherein the orb includes a central core that is surrounded by the plurality of disposable tacky layers.

* * * * *